US005113842A

United States Patent [19]

Moormann

[11] Patent Number: 5,113,842

[45] Date of Patent: May 19, 1992

[54] RAPID FIRE BALL LAUNCHER

[75] Inventor: Randall H. Moormann, Georgetown, Mass.

[73] Assignee: Tonka Corporation, Minnetonka, Minn.

[21] Appl. No.: 514,701

[22] Filed: Apr. 26, 1990

[51] Int. Cl.[5] ..... F41B 11/00

[52] U.S. Cl. ..... 124/65; 124/83

[58] Field of Search ..... 124/65, 66, 64, 63, 124/60, 56, 37, 83

[56] References Cited

U.S. PATENT DOCUMENTS

| | | | |
|---|---|---|---|
| 1,171,197 | 2/1916 | Harmon, Jr. | 124/65 |
| 1,559,789 | 11/1925 | Schmidt et al. . | |
| 2,505,428 | 4/1950 | Pope | 124/65 |
| 2,630,108 | 3/1953 | White | 124/65 |
| 4,892,081 | 1/1990 | Moormann . | |

FOREIGN PATENT DOCUMENTS

| | | |
|---|---|---|
| 2648036 | 4/1978 | Fed. Rep. of Germany . |
| 998710 | 1/1952 | France . |
| 1017638 | 12/1952 | France . |

*Primary Examiner*—Peter M. Cuomo

*Attorney, Agent, or Firm*—Donald Brown

[57] ABSTRACT

A ball launcher for launching a plurality of soft closed cell plastic compressible balls, one ball at a time, by causing a plurality of balls in a line, one ball at a time (each time the plunger is moved back and forth), to squeeze past a constriction at the front of the launcher. The front most ball in the line of balls, to be launched, is urged against the constriction by a resilient biasing carriage engaging the rear most ball in the line of balls.

1 Claim, 6 Drawing Sheets

RAPID FIRE BALL LAUNCHER

BACKGROUND OF THE INVENTION

This invention is directed to a toy for rapidly launching a plurality of soft compressible balls, one at a time, without having to reload the toy after each ball is launched.

The present invention is directed to an improvement of a ball launcher of a general type shown in U.S. Pat. No. 4,892,081, issued Jan. 9, 1990. The toy of this invention has been designed to launch a plurality of balls therefrom, one ball at a time and in rapid succession, rather than a single ball as shown in said patent.

The balls launched by the launcher of this invention, are forced one ball after the other into a front cavity of the launcher to form a line of said balls and by a rapid back and forth motion of a plunger moveable in the launcher, are forced out of the launcher, one ball at a time by compressed air.

BRIEF DESCRIPTION OF THE INVENTION

The invention described herein is directed to a structure having a barrel with an elongated front cavity for holding a plurality of soft balls, e.g., closed cell balls of e.g., polyethylene, one ball after the other in a line.

The line of balls are urged against one another and the first one thereof is positioned against a rigid constriction (without substantially deforming the balls) at the front of the cavity by resilient biasing means, e.g., a spring and a carriage.

A plunger is moveable in a barrel to the rear of the front cavity to cause air therein to first force a first ball closest to the constriction against the constriction to form a seal and then cause the same ball to squeeze past the constriction by the deforming and compression and thus, be launched from the cavity. (See U.S. Pat. No. 4,892,081, FIG. 4 which shows ball deformation and compression as it squeezes past the constriction).

Thereafter, the spring urges the remaining balls in line, forward and urges the next ball in line to be launched to position against the rigid constriction. The next back and forth motion of the plunger causes the next ball to be launched. This process then continues until all the balls are launched.

In order to load the launcher, a plurality of balls are pushed beyond the front constriction, one ball at a time and into the cavity by the user to form a line of a plurality of balls.

DETAILED DESCRIPTION OF THE INVENTION

Figure 1:
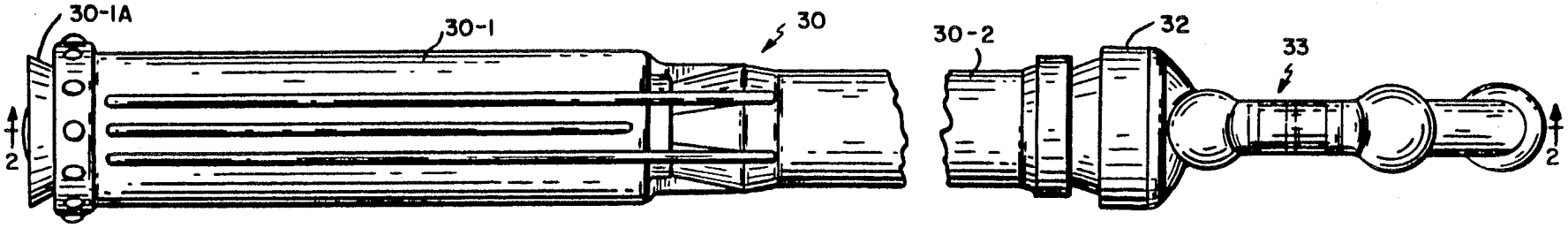
FIG. 1 is a top view of the launcher of the invention.
Figure 2:
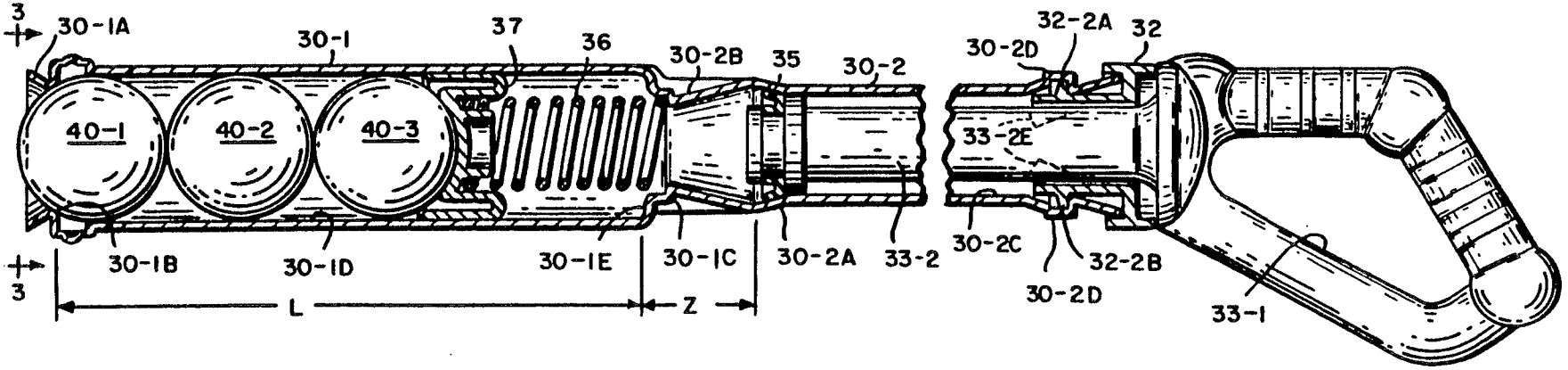
FIG. 2 is a sectional view taken along line 2—2 of FIG.
Figure 4:
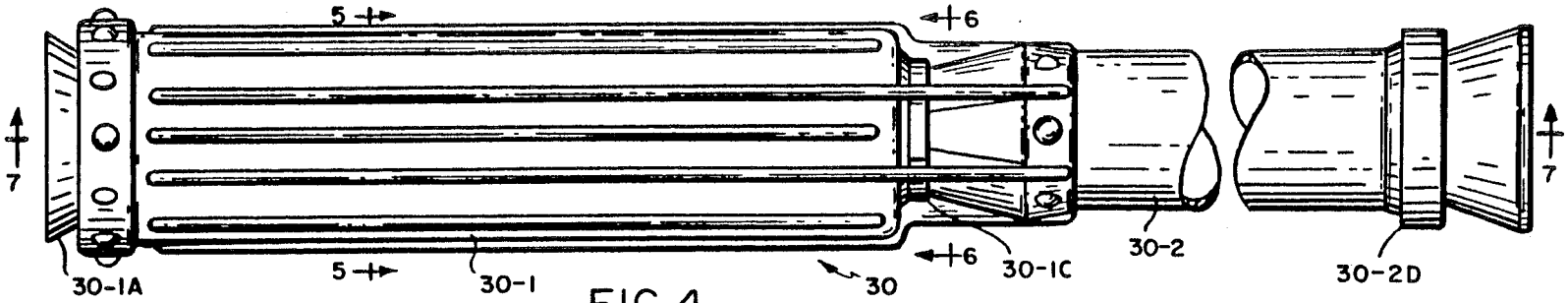
FIG. 4 is a top view of the barrel of the launcher of the invention.
Figure 7:
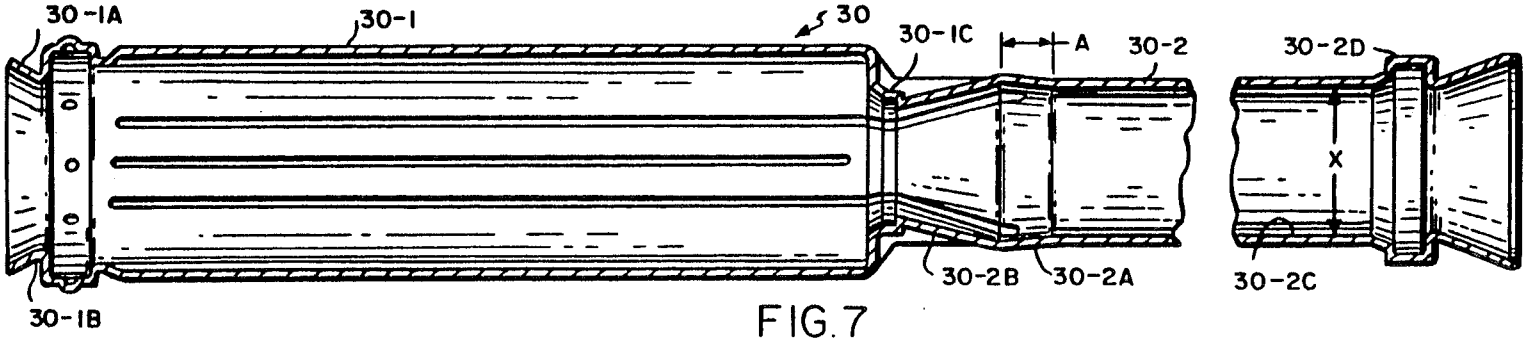
FIG. 7 is a cross section of the barrel of FIG. 4, with the interior parts removed.
Figure 6:
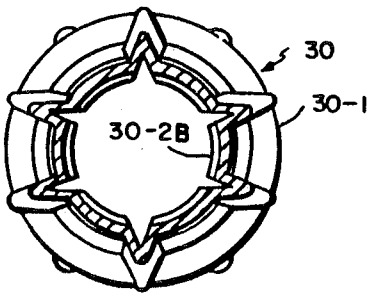
FIG. 6 is a sectional view taken along line 6—6 of FIG. 4.
Figure 5:
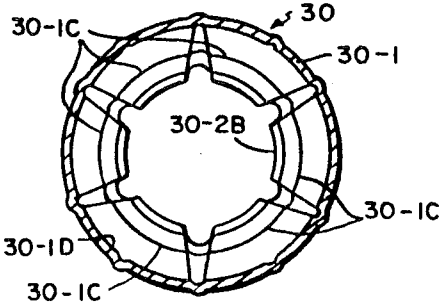
FIG. 5 is a sectional view taken along line 5—5 in FIG. 4.
Figure 3:
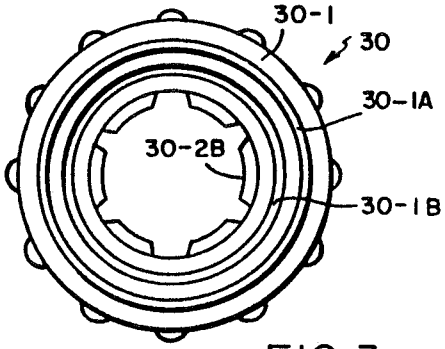
FIG. 3 is a front view taken along line 3—3 of FIG. 2 with the balls, carriage, spring and plunger removed.
Figure 8:
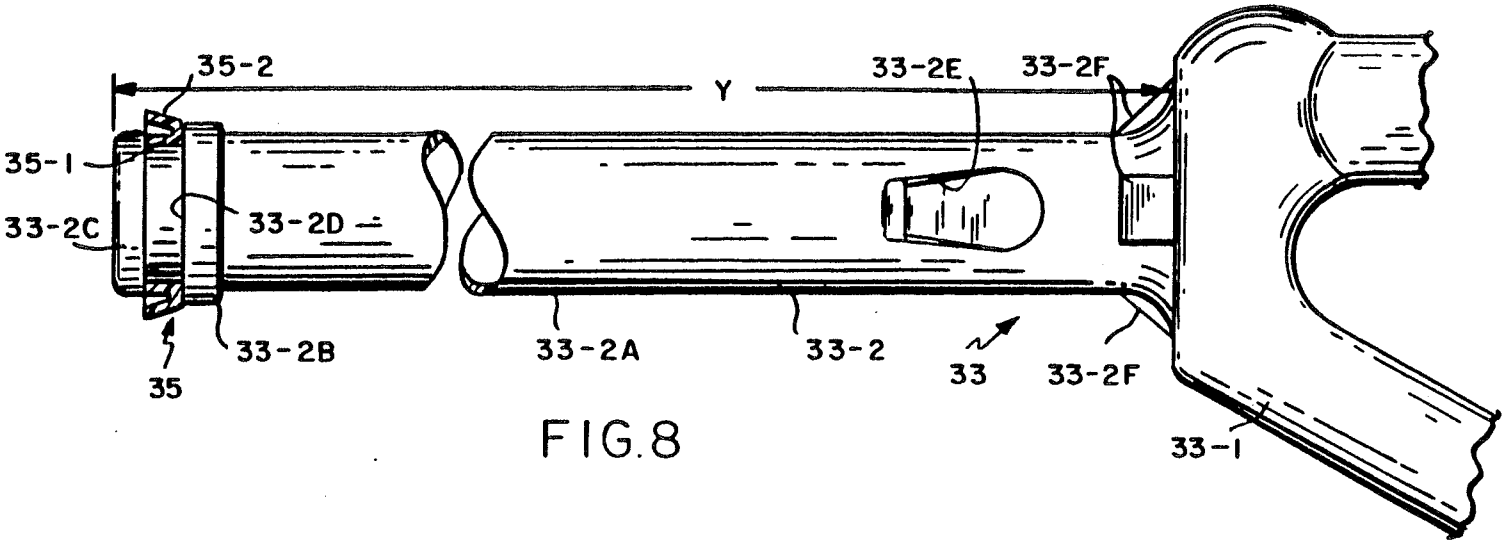
FIG. 8 is a side partial view of the plunger of this invention.
Figure 9:
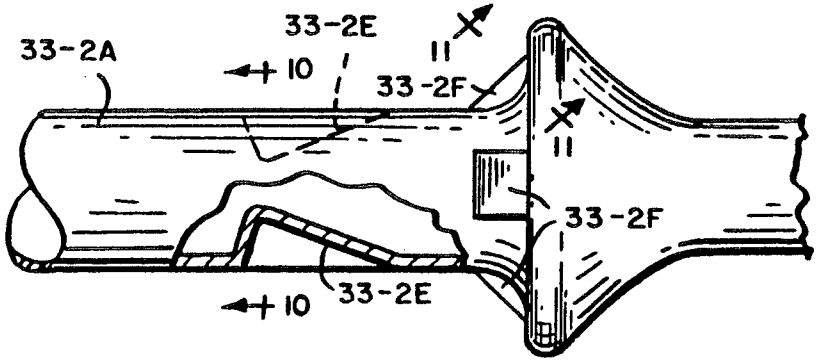
FIG. 9 is a partial sectional view of a portion of the plunger of the invention rotated 90° from that shown in FIG. 8.

Reference should first be had to FIGS. 1 and 2 for a description of the invention.

The device described is a modification of the compressible ball launcher of U.S. Pat. No. 4,892,081, the entire contents of which are incorporated herein by reference hereto.

At 30, there is shown a barrel having a front ball retaining portion 30-1, and a rear portion 30-2 for retaining a portion 33-2 of plunger 33 therein for a slideable back and forth motion as the handle 33-1 thereof is pulled back and forth by the user.

The hollow ball retaining portion 30-1 provides an interior ball retaining cavity 30-1D, in which balls 40-1, 40-2 and 40-3 are retained prior to launch. The inside diameter of cavity 30-1D, is larger than the outside diameter of the balls so that the balls fit loosely, leaving an air gap around the balls in the cavity 30-1D to permit air to act directly on the ball to be launched each time. At the front of barrel portion 30-1, there is a flair 30-1A, which has at the rear a rigid constriction (ring) 30-1B, which is of an inwardly projecting diameter less than the outer diameter of the soft compressible balls 40-1, 40-2 and 40-3 to be launched.

The balls 40-1, 40-2 and 40-3 are resiliently biased against the constriction by the combination of a spring 36, e.g., a coil spring 37 and a carriage 37, slideable in the barrel portion 30-1 cavity 30-1D as shown in FIG. 2.

The spring 36 rests upon a shelf 30-1C formed in the front barrel portion 30-1.

To the rear of the spring, there is provided the barrel portion 30-2, which at the front thereof, are sections 30-2A and 30-2B, which connect it to the front barrel portion 30-1. At 32 there is provided a collar for holding the plunger portion 33-2 in the barrel portion 30-2.

The plurality of balls 40-1, 40-2 and 40-3 are loaded by the user into the barrel portion 30-1 cavity, one at a time by pushing each of the compressible balls, one at a time, past the rigid constriction 30-1B to form a line of balls as shown in FIG. 2. The balls are urged against the constriction by the carriage 37 and spring 36.

The balls 40-1, 40-2 and 40-3 are launched one at a time by the movement of the plunger 33 back and forth by the user. On the forward stroke of the plunger (towards the balls after being drawn rearward), the first ball 40-1 in the line is launched, as the air in the barrel 30 is compressed, by squeezing past the constriction 30-1B. Thereafter the second ball in the line of balls, will be urged by the spring 36 and carriage 37, against the constriction (acting against ball 40-3) for launching upon the next back and then forth movement of the plunger 33. Compressed air acts upon the balls in the cavity (chamber), to cause the balls to be launched, one ball at a time. The plunger 33 is shown in its most forward position in FIGS. 1 and 2.

Reference should now be had to FIGS. 3 to 7, which shows in detail, different views of the barrel 30.

In FIGS. 8 to 11, there is shown an enlargement of the plunger 33 having a handle 33-1 and the slideable portion 33-2. The slideable plunger comprises a central shaft 33-2A with first and second projecting rings 32-2B and 33-2C to form a channel 33-2D therebetween for the seating of an annular air seal 35. The seal is of elastomer plastic and has a portion 35-1, which seats in the bottom of the channel 33-2D between the rings 32-2B and 33-2C. The seal 35 also has a spring like sealing portion 35-2, which slides against the interior 30-2C of the barrel portion 30-2 (See FIG. 2).

Figure 11:
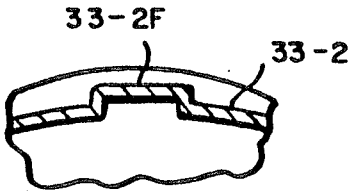
FIG. 11 is a partial sectional view taken along line 11—11 in FIG. 9.
Figure 10:
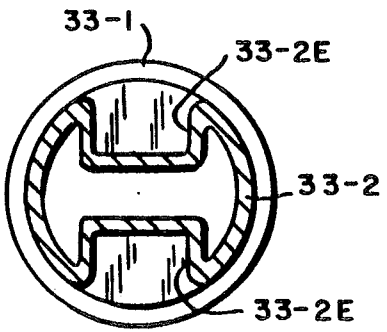
FIG. 10 is a sectional view taken along line 10—10 in FIG. 9, with the plunger shown in the barrel.
Figure 12:
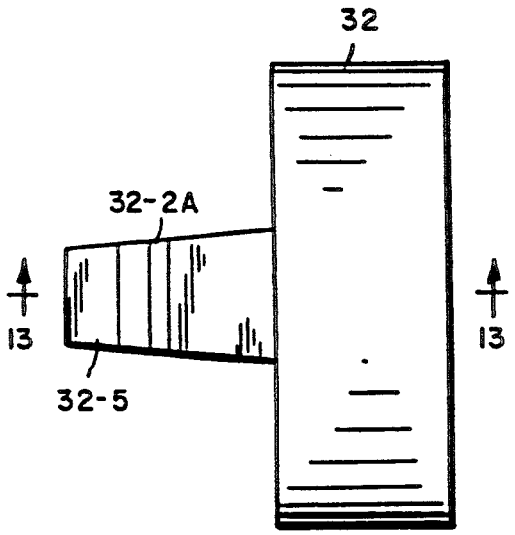
FIG. 12 is a top view of the collar of the launcher.
Figure 13:
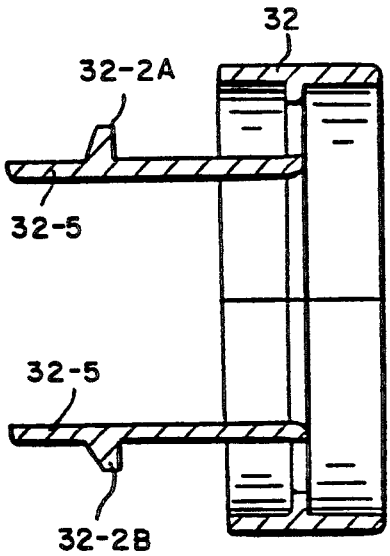
FIG. 13 is a partial sectional view taken along line 13—13 of FIG. 12.
Figure 14:
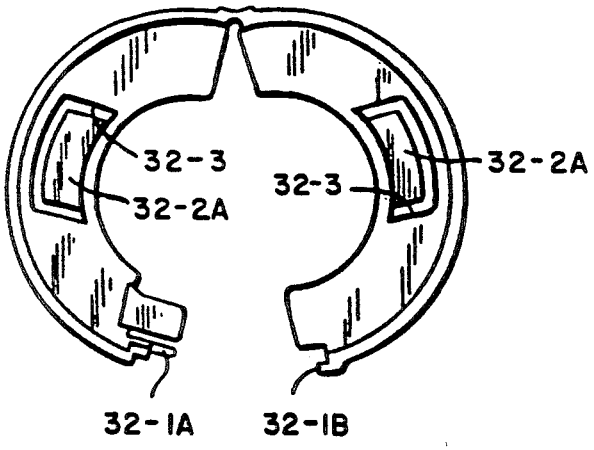
FIG. 14 is an end view of the collar from the right side of FIG. 12.
Figure 15:
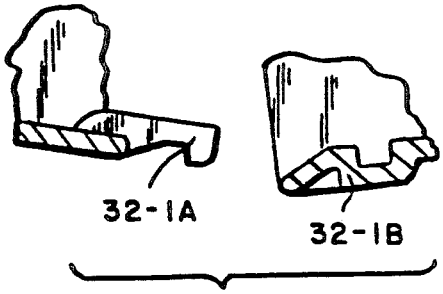
FIGS. 15 and 16 show in sectional views, the structure for holding the collar about the barrel.
Figure 16:
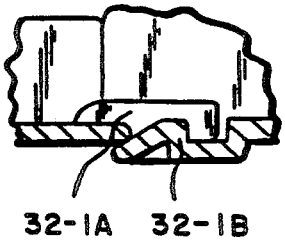

The plunger shaft 33-2A is provided with slots 33-2E for temporarily receiving two detents 32-2A and 32-2B on the collar 32 to be more fully described (FIGS. 12 to 16) to facilitate assembly of the ball launcher. Reinforcing gussets are provided at 33-2F, as seen in FIG. 11.

Reference should now be had to FIGS. 12 to 16, which discloses a collar 32 for assembly of the launcher. The collar comprises two connected halves and is provided with a two part latch assembly 32-1A and 32-1B to couple the two halves together. The collar has the two spring like dents 32-2A and 32-2B, which snap into annular barrel ring 30-2D (See FIG. 2). Air is vented through the collar portions 32-3 as the plunger is drawn rearward. The collar portions 32-5 limit rearward movement of the plunger ring 33-2B.

Figure 17:
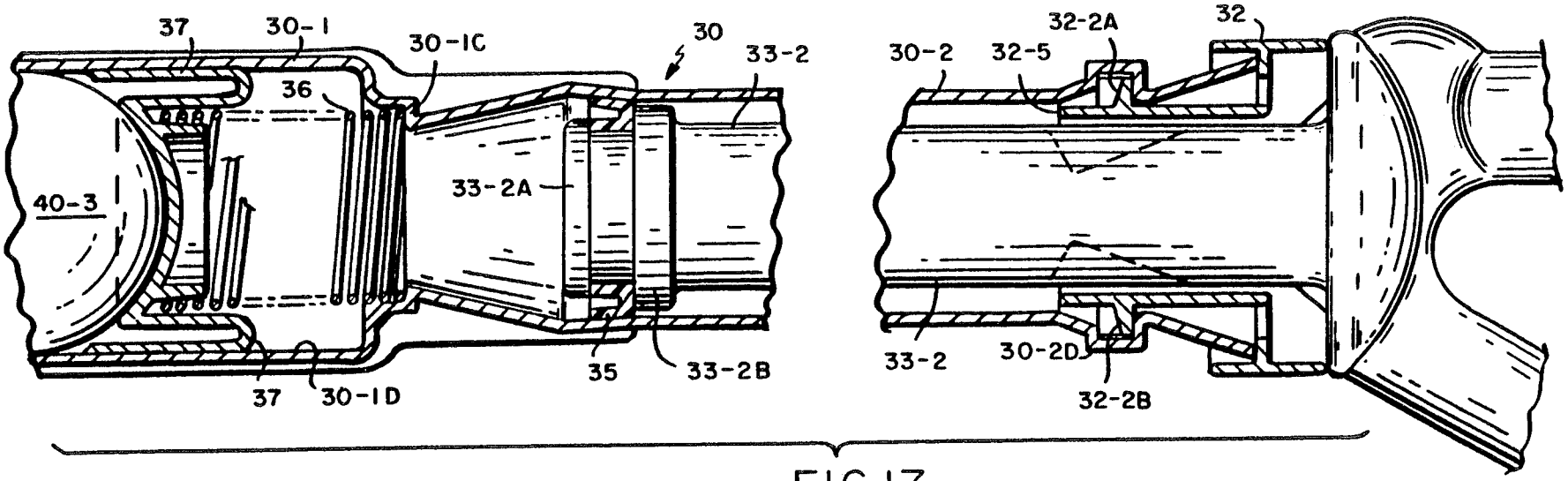
FIG. 17 is a sectional view of the plunger in the barrel and spring assembly positioned to urge the line of balls against the front cavity constriction prior to launching one of three balls.
Figure 21:
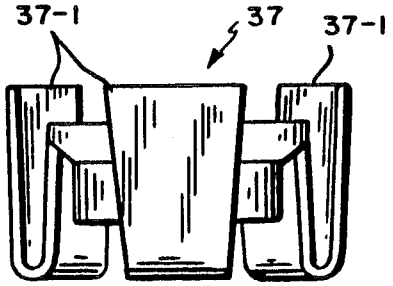
FIG. 21 is a top plan view of the ball carriage looking down on FIG. 20.
Figure 20:
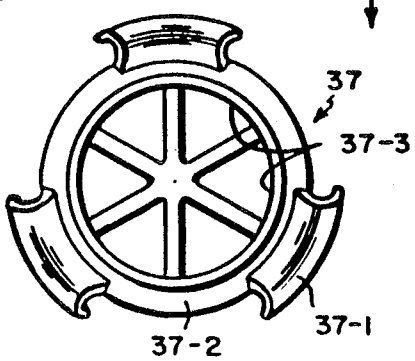
FIG. 20 is a rear view of the ball carriage of the invention.
Figure 19:
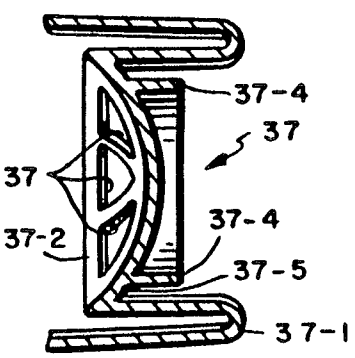
FIG. 19 is a sectional view taken along line 19—19 in FIG. 18.
Figure 18:
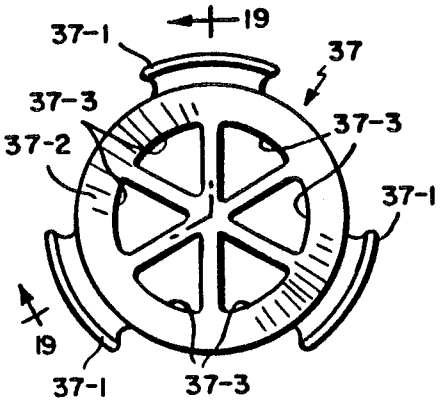
FIG. 18 is a front view of the ball carriage, which is urged against the balls by a spring.
Figure 23:
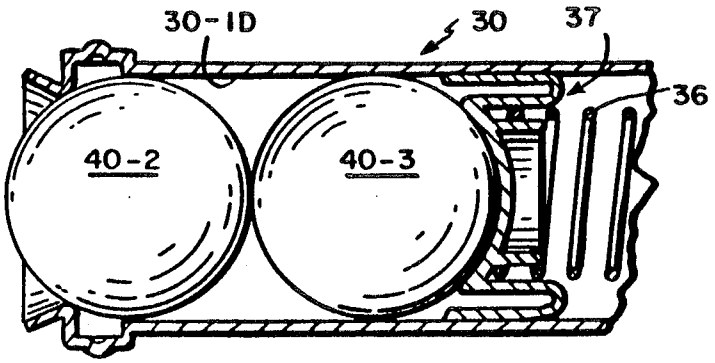
FIG. 23 is a view similar to FIG. 22 after the launching of the first ball is the line.
Figure 25:
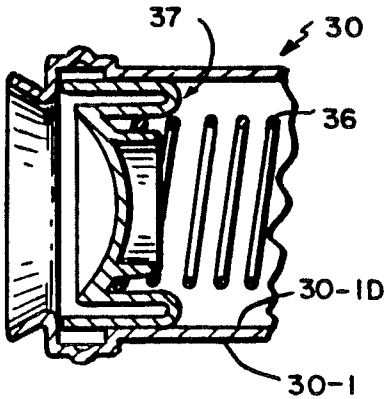
FIG. 25 is a view similar to FIG. 24 after all the balls have been launched.
Figure 22:
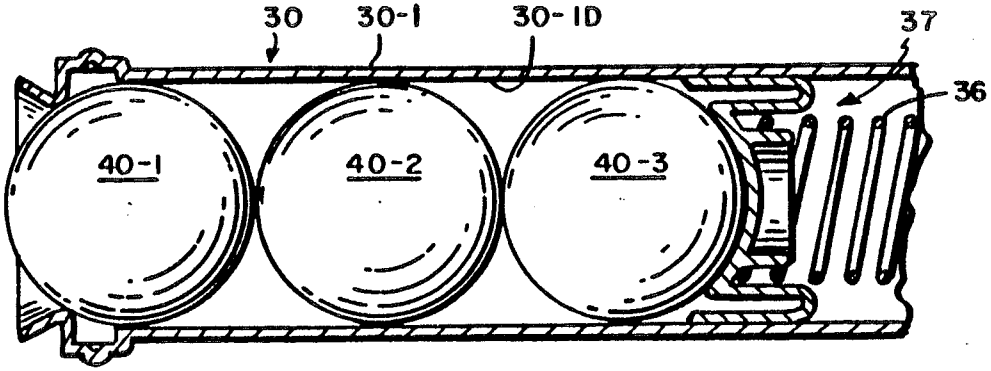
FIG. 22 is a sectional view of the front barrel cavity showing three balls positioned in a line and with the line of balls urged forward with the most forward ball positioned against the constriction by a spring.
Figure 24:
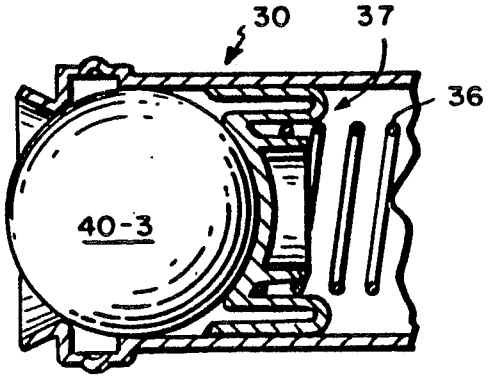
FIG. 24 is a view similar to FIG. 23 with only one ball left to the launched.

In FIGS. 17 to 21 shown in more detail, is the spring 36 and the ball carriage 37. The carriage has ears 37-1 for slideable engagement with barrel interior 30-1D. Because of the carriage shape, it does not act as an air seal. The carriage has a ball engaging cuplike portion 37-2 with holes 37-3 to lighten the part. The carriage rather than a spring is used to hold the balls so as not to cause the balls to deform as well as to make it possible to load a plurality of balls without the spring skewing which would cause a jam during loading because the spring would become pinched between the ball and the cavity 30-1D interior. An annular ring 37-4 is provided and forms an annular slot 37-5 for receiving the spring 36 as shown in FIG. 17.

In FIGS. 22 to 25, there is shown in sequence of ball position and carriage location after each ball is launched, one ball at a time, for each back and forth movement of the plunger. The plunger forward motion (to the left of FIG. 1, after being moved rearward), causes air under pressure to launch the balls one at a time.

The inner cavity (magazine) 30-1D is of inner diameter, which is wider than the outer diameter of the balls 40-1, 40-2 and 40-3 to prevent the balls from taking a permanent set and thus losing their round shape and to allow an air gap. The ball 30 is preferably of a multi-cellular closed cell foam material such as polyethylene or the like and is able to compress at least 5% and preferably at least 10% to 25 % of its original diameter and then spring back to its initial shape so that the ball appears to explode out of the barrel. About 10% ball diameter compression appears to be quite satisfactory. The ball launcher device of this invention is preferably constructed of plastic such as polyethylene or the like. The front seal 35 is preferably of an elastomer, e.g., PVC or natural rubber.

In order to insure that a single ball will be launched each time rather than multiple balls, the pressure of air within the barrel between the front most ball and the forward most position of the plunger is controlled to be sufficient to launch one ball, but not sufficient to launch the second ball in the line of balls. Therefore, with a ball 40-1 of a 1.75 inch diameter and compressible about 10% as currently on the market and sold by Parker Brothers for more than one year in connection with the Blast-A-Ball® launcher (the device of U.S. Pat. No. 4,892,081), the barrel may be for example, designed with a constriction 30-1B diameter of 1.575 inches, and internal front cavity 30-1D barrel diameter of 1.84 inches, a dimension L (See FIG. 2) of 7.25 inches, inner diameter X (See FIG. 7) in chamber (cylinder) 30-2 of 1.36 inches, section 30-2A having a length A of 0.44 inches and section 30-2B to the backstop 30-1E for the carriage as shown as Z in FIG. 2 has a length of 1.15 inches with the plunger having a stroke of 11 inches. The plunger portion 33-2 has a length Y of 13.51 inches. (See FIG. 8).

It is understood that appropriate changes in dimensions and etc., may be made by one skilled in the art to practice the invention and therefore this invention is not in any way meant to be limited by the example given above.

I claim:

1. A ball launcher comprising a barrel, a plunger positioned in the barrel for slideable motion therein, the front portion of the barrel having a cavity for retaining a plurality of compressible balls therein, said cavity having a rigid constriction at the front of the cavity, a carriage and spring means supported in said barrel and positioned in the front cavity thereof, said carriage positioned to contact one of said balls, said spring means urging said carriage to urge said balls towards said constriction, said carriage having a cuplike portion in the shape of a portion of a ball to be received therein, and a plurality of ears for sliding on the interior of the barrel, said ears being spaced apart about the said carriage and having a curved surface in contact with said barrel inside surface to prevent the carriage from skewing in said barrel and to permit air to flow back and forth between said ears, said plunger back and forth motion towards and away from said carriage and said constriction forcing said balls one at a time to squeeze past said constriction and be launched.

* * * * *